US005316304A

United States Patent [19]

Yost

[11] Patent Number: 5,316,304

[45] Date of Patent: May 31, 1994

[54] WIRE FACED GOLF PUTTER

[76] Inventor: David A. Yost, 3504 Windsor Cir. NE., Cleveland, Tenn. 37312

[21] Appl. No.: 215

[22] Filed: Jan. 4, 1993

[51] Int. Cl.[5] ..... A63B 69/36; A63B 53/04

[52] U.S. Cl. ..... 273/168; 273/78; 273/175; 273/186.2; 273/184 R

[58] Field of Search ..... 273/187.4, 78, 167 J, 273/168, 186.2, 184 R, 185 R, 175

[56] References Cited

U.S. PATENT DOCUMENTS 5,116,054 5/1992 Johnson ..... 273/168 X

FOREIGN PATENT DOCUMENTS 23845 of 1906 United Kingdom ..... 273/78

2717 of 1909 United Kingdom ..... 273/78

*Primary Examiner*—George J. Marlo

*Attorney, Agent, or Firm*—J. W. Gipple

[57] ABSTRACT

This invention is the application of a tensioned wire striking surface to a golf putter. The wire is placed such that several turns form a flat plane over a concave portion on each side of the putter. Positioning and anchoring grooves on each end of the putter receive the wire and assure uniform tension and resultant musical tone. The putter is not adjustable, but is fixed in position. The shape of the structural and weight member is such that a high moment of inertia to rotation is achieved.

The invention is an improvement over an earlier invention describing the application of tensioned wire striking surfaces to golf clubs, not including putters.

3 Claims, 2 Drawing Sheets

WIRE FACED GOLF PUTTER

BACKGROUND OF THE INVENTION

This is the specification and description for a wire-faced golf putter, which is manufactured with high tensile wire forming the striking face of the putter. This invention is an improvement over U.S. Pat. No. 890,836, dated Jun. 16, 1908 as granted to Harold Beale of London, England.

SUMMARY OF THE INVENTION

1. Application to a golf putter, rather than to a golf club. The use of tensioned wires for putting is a practical application since the striking forces required for putting are within the limits of stress of modern materials of construction.

2. Wire striking face on two sides to permit either right or left hand use.

3. Wires are placed to allow free vibration and therefore provide a musical tone after striking the ball.

4. A workable method of attaching and anchoring the wire ends in the putter body.

5. A natural shape of the putter to accommodate wires and deflection space which provides a high moment of inertia to rotation.

6. A single length of wire wrapped such that the stresses can equalize over all passes and therefore provide a constant resistance to deflection and a common musical tone.

A drawing is attached showing details of construction of the putter. The drawing is composed of six figures, described as follows:

DESCRIPTION OF PREFERRED EMBODIMENTS

Figure 1:
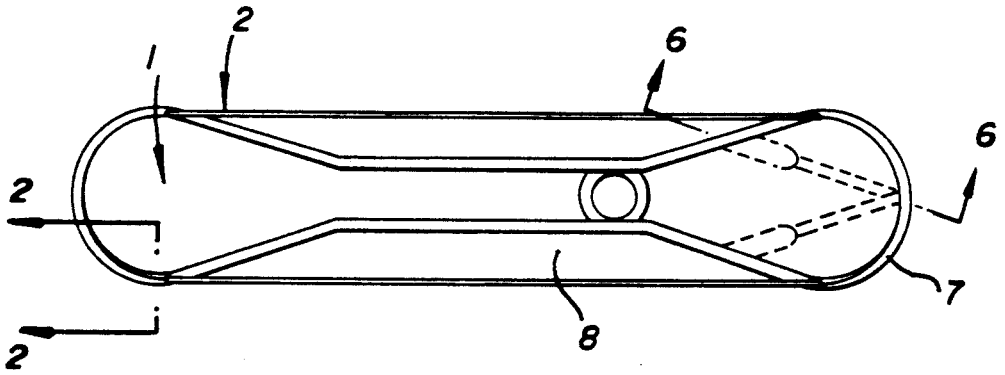
FIG. 1: Top view of the assembled putter.
Figure 2:
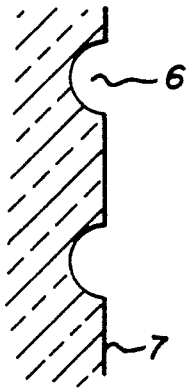
FIG. 2: Sectional view of retaining grooves.
Figure 3:
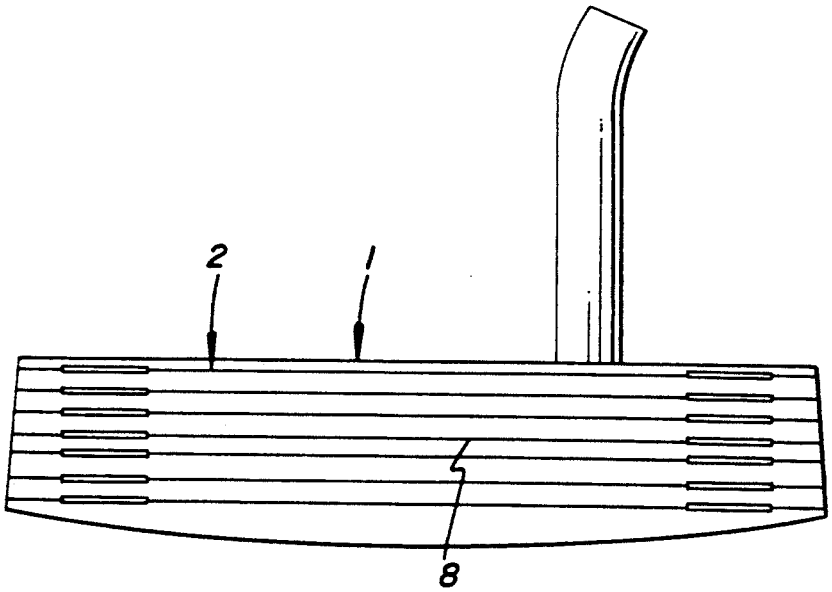
FIG. 3: Side view of the assembled putter.
Figure 4:
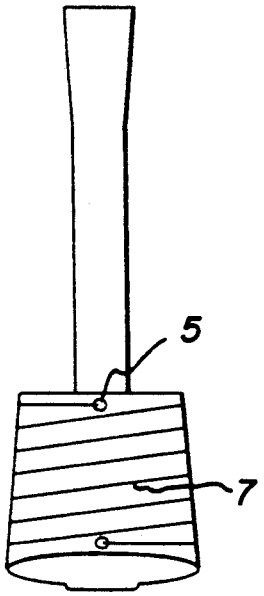
FIG. 4: End view of the assembled putter.
Figure 5A:
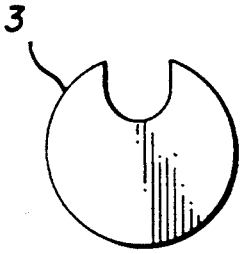
FIGS. 5A and 5B, respectively, show end and side view details of the cinch pin.
Figure 5B:
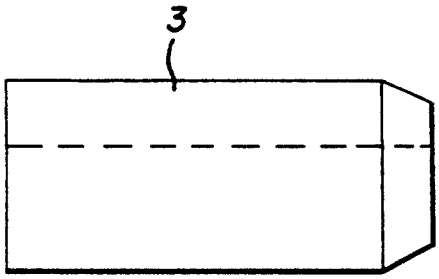
Figure 6:
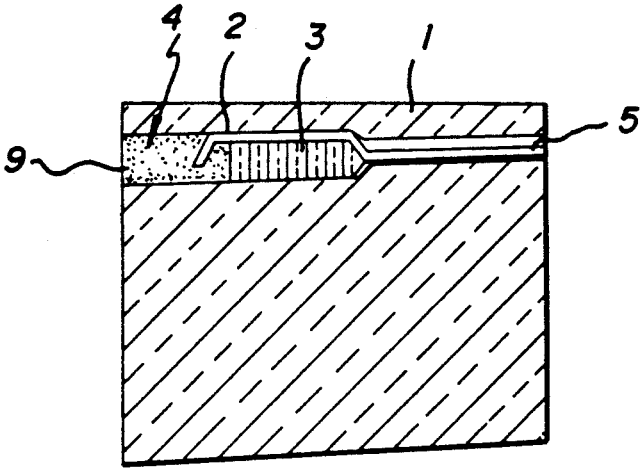
FIG. 6: Sectional view of wire anchor assembly.

The drawings show the putter is comprised of four basic elements.

1 is the structural and weight providing member. It is a metal part shaped such that wires 2 may be wrapped around it and held under tension with grooves 6 in the end 7 of the putter head and anchors. A recess 8 is provided behind the striking area on each side of the putter to allow for deflection and vibration of the wires. The working model of the putter is made of brass; other materials and metals may be used that provide acceptable strength and weight qualities.

2 is the tensioned wire. The working model has a single strand of high-tensile stainless steel wire with seven turns or passes on each side. Other wire materials could be used and more or less passes of wire could be used.

3 is a grooved, cylindrical cinch pin. This pin is driven to the bottom of a hole 9 having the same diameter as the pin and through which the wire has been drawn under tension. As the pin is driven to the bottom of the hole it deforms and pinches the wire such that it cannot move in the direction of residual tension. The wire passes out of the hole through a smaller hole 5 leading to the exterior surface.

4 is a fill of epoxy material to hold the wire end in a clinched position and fill the resultant void of the hole for appearance.

I claim:

1. A golf putter comprising a solid, elongated head having two striking surfaces on opposing sides thereof and means for accommodating a shaft on the top surface of said head; said elongated head being circumferentially bound by a plurality of parallel wire strands which laterally traverse opposite sides of said head and form said striking surfaces; the opposite sides of said head including a concave mid portion across which said wire strands extend the opposing ends of said putter being provided with hemispherical grooves to accommodate said strands.

2. The golf putter of claim 1 wherein said wire strands are a single, continuous length of wire.

3. The golf putter of claim 1 wherein the ends of said wire strand are anchored in holes in said head by pins inserted therein.

* * * * *